US005197859A

United States Patent [19]

Siff

[11] Patent Number: 5,197,859

[45] Date of Patent: Mar. 30, 1993

[54] WELL PUMP SYSTEM

[76] Inventor: Elliott J. Siff, 15 Broadview Rd., Westport, Conn. 06880

[21] Appl. No.: 619,581

[22] Filed: Nov. 29, 1970

[51] Int. Cl.[5] ..... F04D 15/00

[52] U.S. Cl. ..... 417/19; 417/20; 417/26; 417/29; 417/43; 417/45

[58] Field of Search ..... 417/19, 20, 26, 29, 417/38, 43, 45

[56] References Cited

U.S. PATENT DOCUMENTS 3,692,430 9/1972 Timmons ..... 417/26

4,329,120 5/1982 Walters ..... 417/38

4,344,741 8/1982 Taki ..... 417/29

*Primary Examiner*—Richard A. Bertsch

*Assistant Examiner*—David W. Scheuermann

[57] ABSTRACT

A well pump system having a motor-driven pump and a pressure tank for delivering water from a source to a utilization point. A sensing device detects a parameter correlated to the rate of flow into and out of the pressure tank. The parameter is utilized to regulate flow into the tank so as to establish at least approximate equality between flow into and out of the tank.

13 Claims, 3 Drawing Sheets

WELL PUMP SYSTEM

This invention relates generally to pumps and pumping systems and, in particular, to those employed in drawing a domestic water supply from wells. Such wells may be of the deep, drilled type employing submersible pumps and motors, disposed at or near the bottom of the well bore, or shallow wells in which the pump and its drive motor are located at ground level, usually in proximity to a pressure tank, a practically indispensable component of both types of systems. Due to problems of pollution, low water tables, etc., shallow wells are relatively uncommon in the present day.

THE PRIOR ART

Conventional domestic well water supply systems almost universally comprise a pump driven by a constant speed electric motor. The pump intake is located in the water reservoir of the well, its outlet delivering the water output to the inlet of a pressure tank. The tank inlet is located near its bottom as is its outlet, which is connected in flow communication to the main water supply pipe of the residence or other facility to be provided with a supply of running water.

The tank inlet and outlet are located in the lower end of the tank in order that the upper portion can contain a captive volume of air which is compressed as water is forced into the tank inlet by the well pump. A pressure switch in the tank controls the motor in response to the pressure accumulated in the tank. The pressure switch has high/off and low/on limit switches, usually adjustable, so that when the pressure reaches a preset upper limit the pump stops and remains off until pressure in the tank falls below the lower limit due to water consumption, at which time the pump starts and continues in operation until the pressure is restored to the upper limit.

While various refinements have been made over the years, e.g., in the jet pumps, the use of bladders within the pressure tank to prevent loss of the air head (waterlogging), the basic system has remained unchanged and its primary shortcoming continues to plague well water users. This shortcoming is the cycling of the pump and the attendant rise and fall of water pressure. In this connection it will be noted that the adjustment of the pressure limits has conflicting requirements.

If the difference in pressure limits is small, say, 40 psi as the lower value and 50 psi for the upper value, the fluctuation in water pressure is reduced but at the price of frequent cycling of the pump on and off. This is highly undesirable as it greatly reduces the life of the pump motor and the pressure switch. These components have a finite service life measured, not in terms of years but in terms of the number of times they are switched on and off. Consequently, setting the pressure switch to minimize pressure fluctuation will shorten the life of the motor by years of service.

The replacement of the motor is a relatively expensive undertaking, particularly when the system is for a deep well with the submersible pump located perhaps 100 or 200 feet below the surface. Another cost factor to be considered is the electric power consumption by the motor. As is well known, the greater part of the power consumption by electric motors is in the starting current drawn. Frequent cycling therefore greatly increases the energy cost of operation of the system.

The extreme case of frequent cycling is encountered in so-called "demand" water systems widely used in motor homes, travel trailers, and such recreational vehicles. The demand system has no pressure tank. The pump motor is controlled by a pressure switch which is responsive to pressure in the water line on the outlet side of the pump. As there is no captive air volume in the line, and water is of course substantially incompressible, the line pressure drops to nearly zero almost instantaneously when a faucet is opened and, unless the faucet is fully opened and has sufficient flow capacity to accommodate the entire output of the pump, the pressure in the line rapidly rises to the pressure limit and the motor stops, only to start again moments later. Even if the faucet has sufficient flow capacity to permit the pump to run continuously, the limited water supply in motor homes when under way (typically less than 100 gallons in all but the larger units), makes it injudicious to fully open the tap.

With this state of the art in view, it is the basic general object of the invention to overcome or at least mitigate the drawbacks and disadvantages of conventional well pump systems as described above.

A more specific object is to prolong the service life of well pumps and pressure switches employed in domestic well water supply systems.

Another object is to enable the design of domestic well water supply systems capable of supplying water at substantially constant pressure and flow rates at all but the smallest usage volume.

A further object is the provision of more highly energy efficient water supply systems.

To the accomplishment of these and further objects which will become apparent as this description proceeds, the invention contemplates a pumping system for domestic water supplies which comprises a source of water, a water accumulation chamber having an inlet and an outlet, and a pump operatively disposed in flow communication between the water source and inlet whereby water is supplied from the source to the chamber in response to operation of the pump. In addition, means are provided for detecting at least one fluid flow parameter associated with, and dependent upon the rate of flow through, the inlet and outlet of the chamber and utilizing the parameter to regulate the rate of flow into the chamber so that the rates of flow into and out of the chamber are substantially equal and the pump runs continuously during water usage for all but the smallest rates of such usage.

BRIEF DESCRIPTION OF THE DRAWINGS

Exemplary embodiments of the invention will be described presently in conjunction with the annexed drawings in which like reference characters denote like parts throughout the several views

DESCRIPTION OF PREFERRED EMBODIMENTS

Figure 1:
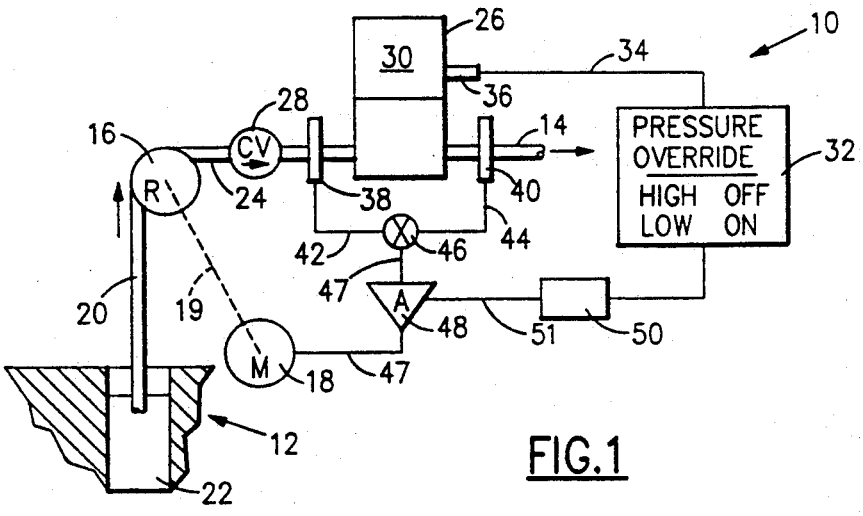
FIG. 1 is a diagrammatic representation of a well pump system according to one embodiment of the invention.

FIG. 1 diagrammatically illustrates a typical domestic water supply well pump system 10 embodying the present invention. The system is designed and arranged to draw water from a well 12 or other source of water and to deliver it under pressure to an outlet pipe 14 connected to the piping (not shown) of a residence or other structure or facility requiring it.

For simplicity of illustration well 12 is shown as a shallow or dug well but most often would be deep or drilled well as will be described in due course in connection with another embodiment of the invention.

A well pump 16 driven by an electric motor 18, as symbolically represented by broken line 19, has its inlet connected to an intake pipe 20 extending into the reservoir of water 22 in the well. Pump outlet conduit 24 leads to a pressure tank or accumulator 26, typically having a capacity in the order of 50 to 100 gallons, and is connected in flow communication with the tank at a point near the tank bottom. Tank outlet 14 is similarly connected near the bottom of the tank.

Between pump 16 and tank 26, pump outlet conduit 24 contains a check valve 28 which permits water to flow only in a direction (to the right as viewed in FIG. 1 and indicated by the arrow) from the pump to the tank.

Tank 26 defines an accumulator chamber 30 containing a captive volume of air trapped above the level of water in the tank due to the bottom connection of the pump outlet pipe 24 and tank outlet 14. A pressure override switch 32, connected to tank 26 as indicated by line 34 and tap 36, has selected high and low pressure limit presets which turn the pump motor on at a selected low pressure point and off at a high pressure point.

As thus far described the system is conventional and in such a system the switch controls motor 18, so that when water consumption from the tank reduces the pressure to the preset lower limit, e.g., 40 psi, the motor starts, driving the pump 16 to force water through pump outlet conduit 24, past check valve 28 into the accumulation chamber, compressing the air head in chamber 30 until the preset upper limit e.g., 60 psi, is reached. Thereupon, the pressure switch 32 is moved to the off condition, de-energizing the motor and stopping the pump. Check valve 28 prevents back-flow of water from tank 26.

As previously explained, conflicting desiderata force an unhappy trade off in the setting of the upper and lower pressure limits. One desideratum is uniform, relatively high pressure water flow at all water usage rates and to multiple consumption sites. This can be approached albeit not entirely achieved by setting the upper limit at a relatively high pressure, say 70 pounds, and the lower limit not too far below, say 60 psi. While this tends to reduce pressure fluctuations, it is accompanied by frequent on-off cycling of the pump motor which is damaging to the motor as well as other components of the system, including the pressure switch and the flexible cable which suspends the pump and motor assembly in deep wells, drastically shortening their service life.

The detrimental effect of frequent starting on the motor is overheating which accelerates bearing wear and deterioration of insulation. As for impact on the flexible cable it will be noted that reaction torque produced at starting causes shifting and twisting of the cable causing it to rub against proximate fixed structure, such as the well casing, resulting in rapid wear. Replacement of either or both the motor and/or the suspending cable is a costly proposition.

Of equal or perhaps greater importance in times of energy shortages and high energy costs is the increased power consumption resulting from frequent starting of the electric motor and the attendant high starting current draw.

The alternative setting of pressure limits, i.e., a large differential between the upper and lower set points reduces the frequency of on-off cycles but yields satisfactory flow rates only at or near the high end of the range; flow gradually diminishes as the tank pressure falls and flow becomes barely useful as the lower limit is approached, particularly if more than one water-consumption valve is open.

The problem is overcome by modification of the conventional well pump system shown in FIG. 1 according to the present invention. Instead of the fixed speed motor (18) normally used in the system, a motor of the variable speed type is employed. The speed of the motor is governed by an error signal representative of the difference in the rate of flow into and out of tank 26.

To this end, a flow rate sensor 38 is placed in conduit 24 and another flow rate sensor 40 in the outlet conduit 14 of the tank. Any suitable type of flow rate measuring device or flow meter may be used, with the requirement that it generate a signal susceptible of logical manipulation. An electrical signal would be the most likely to be used in commercial implementations of the invention in the present state of the art.

The signals generated by flow rate sensors 38 and 40 on conductors 42 and 44 are compared in suitable logical device such as comparator 46 and the difference fed to a control amplifier 48. A power supply 50 has its output connected to amplifier 48 which controls the input of power supplied to motor 18. Thus the speed of motor 18 is regulated in accordance with the difference in flow rate of water being pumped into the tank and water being drawn from the tank for consumption. It will be understood that, in systems embodying the present invention, pressure switch 32, which is the sole control of the operation of the pump motor 18 in conventional systems, serves only as an over-ride.

When no water is being used, there is neither inlet nor outlet flow; the flow sensors generate a null or equal signals at the comparator, the output of which turns off the amplifier and with it the current from power supply 50 to the pump motor. This is the standby condition. When a faucet is opened, the outlet sensor detects the resulting flow in outlet conduit 14 and responds with a signal on conductor 44 to comparator 46 which is receiving no signal (zero flow) from the tank inlet rate sensor 38. The resulting imbalance constitutes an error signal which is passed to amplifier 48 which in turn passes energizing current from power supply 50 to motor 18.

The magnitude of the energizing current is proportional to the magnitude of the error signal. As the motor and concomitantly the pump speed increases from zero to a finite value, the rate of flow into the tank also increases from zero to a finite value, thus reducing the difference between inlet and outlet flow rates. In the manner well known in the art of servo-systems, the pump and motor speed varies so as to eliminate the error signal and thus match the inlet flow rate to the rate of water consumption. Once started, due to the pressure in chamber 30 dropping below the preset lower limit, the pump runs continuously when water is being used and while its speed varies it stops only after water usage stops.

Figure 2:
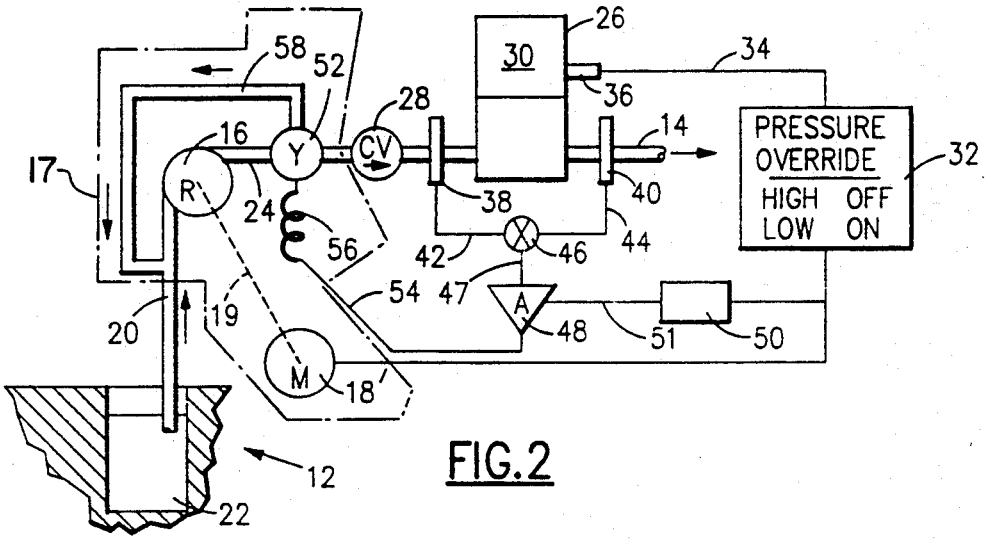
FIGS. 2, 3 and 5 are views similar to FIG. 1, showing additional embodiments of the invention.

The advantages of the invention can be achieved to a large degree with a lower cost embodiment, shown in FIG. 2 the similarity of which to the system already described will be readily apparent. Accordingly, it will be necessary to describe only the differences between the systems.

In the FIG. 2 embodiment, pump motor 18' is of the fixed speed type generally used in conventional well pump systems. The output from control amplifier 48 instead of regulating motor speed, controls the position of a normally-closed, solenoid-actuated bypass valve 52 located in conduit 24. To this end, a conductor 54 couples the output of amplifier 48 to the solenoid 56 of valve 52.

Figure 6:
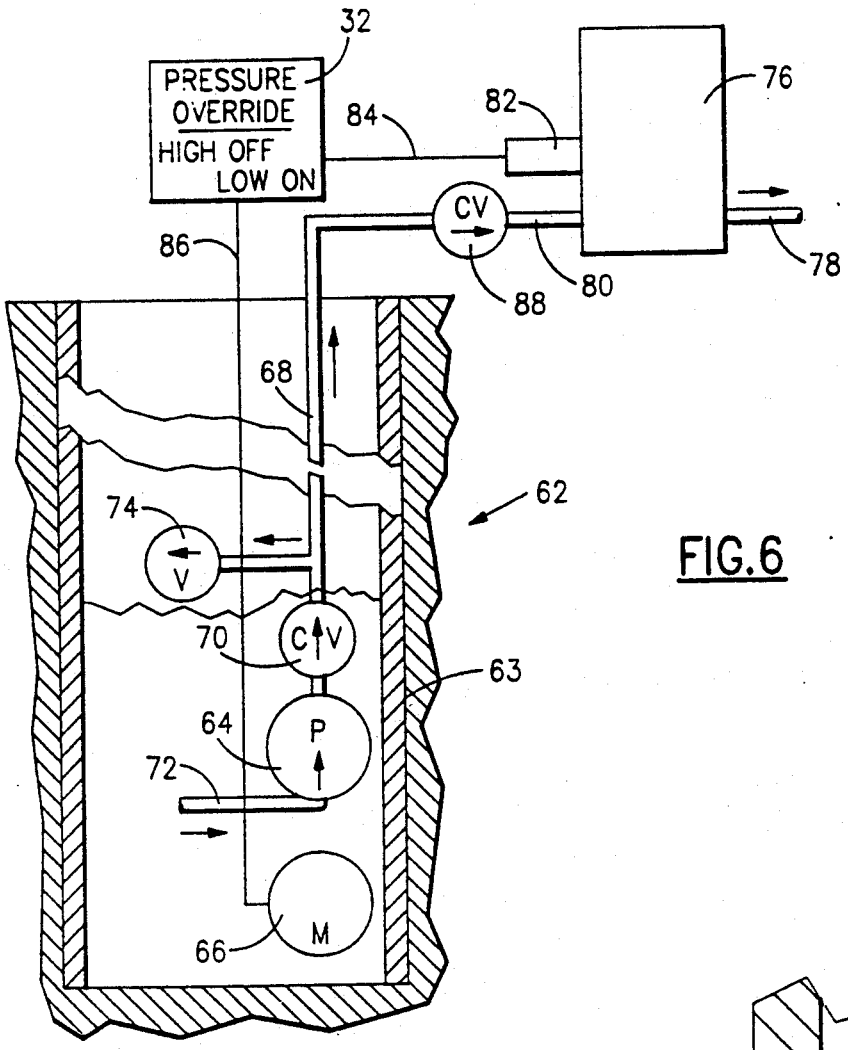
FIG. 6 is a diagrammatic illustration of an embodiment of the invention substantially identical to that in FIG. 3 but showing additional structural details and slight variations in construction.
Figure 7:
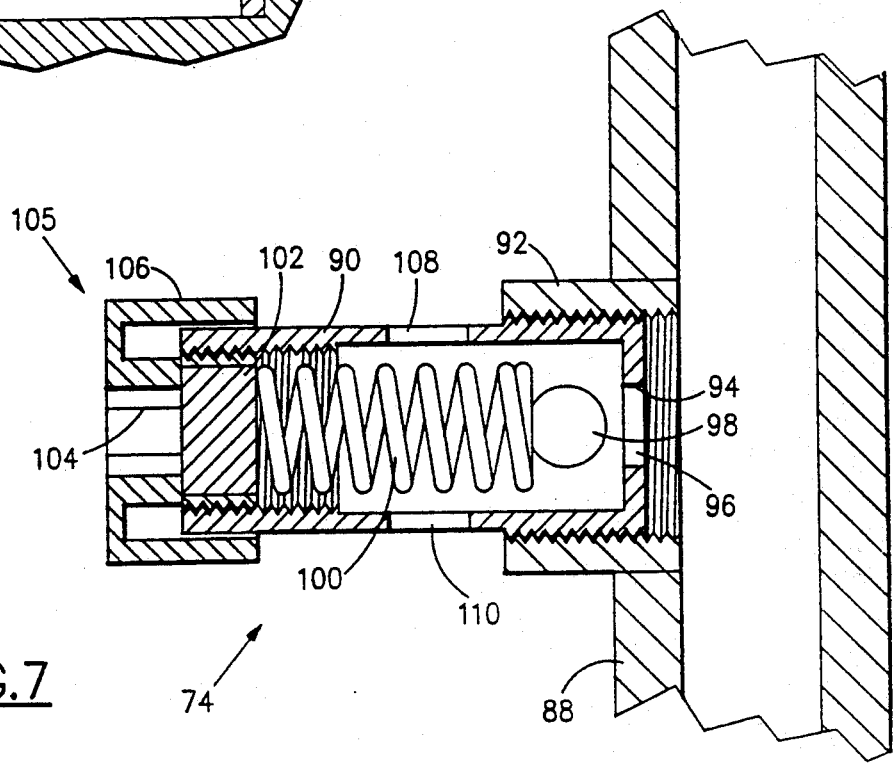
FIG. 7 is a sectional view of a bypass valve used in the system shown in FIG. 6.

A bypass flow conduit 58 carries water from the bypass valve back to the inlet of pump 16 when the valve is opened, as indicated by the arrows. To minimize external piping, the bypass valve and conduit are built into the pump housing 17. This is particularly advantageous in recreational vehicle applications as it obviates the need for a return line to the water supply tank. It will be understood that the bypass flow can be returned to the well instead of the pump inlet, as shown in the embodiments of FIGS. 3 and 6,7.

In operation, the system functions in the same general manner as that shown in FIG. 1 except that the error signal controls the degree of opening of bypass valve 52 instead of the speed of the pump drive motor. Thus, starting from the standby condition with both inlet and outlet flows at zero and the pump motor inoperative: opening a faucet results in the generation of an output flow signal by sensor 40 unbalancing the null condition at comparator 46 which outputs an error signal to energize the solenoid 56 of bypass valve of 52, by an amount inversely proportional to the magnitude of the error signal, once the low-pressure/power-on switch has been activated. If the water drawn is at a slow rate, the bypass valve opens wide enough to recirculate a sufficient volume of water to prevent pressure in the tank from building up and opening the pressure over ride switch and stopping the pump motor. This is what occurs at extremely low usage rates.

Ideally, the bypass operates to maintain the volume of recirculated water equal to the pump's output capacity minus the volume of consumption. Properly designed, the pump operates continuously during normal rates of consumption and turns off only when the rate is extremely low or nil. The maximum bypass flow permitted by valve 52 should be less than 100% of pump capacity in order for pressure in the tank to build up to the high pressure cut off point for switch 32 when demand stops. Practical design for valve 32 is determined empirically and is a function of the demand pattern. Even a 50% or 60% maximum bypass volume would considerably reduce the frequency of on/off cycling.

Figure 3:
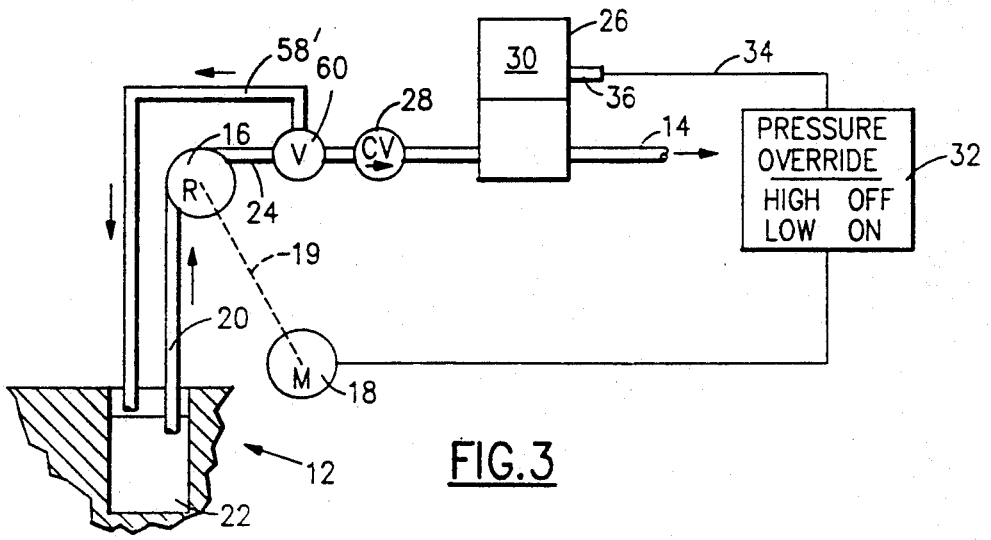

Still another embodiment of the invention illustrated in FIG. 3 further reduces the cost of the system. Again, due to the similarity to the systems already described, the FIG. 3 embodiment will be described only in aspects differing from, and by comparison with, those systems.

In the FIG. 3 embodiment, the servo-system components present in FIGS. 1 and 2, viz., flow rate sensors 38 and 40, logic component 46 and control amplifier 48 have been eliminated and the solenoid-operated bypass valve replaced with a normally-closed, spring-loaded bypass valve 60. The details of a particular construction of the spring-loaded bypass valve, as shown in FIG. 7, will be described presently. Due to its simplicity and structural similarity to a conventional well pump system, the FIG. 3 embodiment lends itself to retro-fitting of existing systems.

Figure 5:
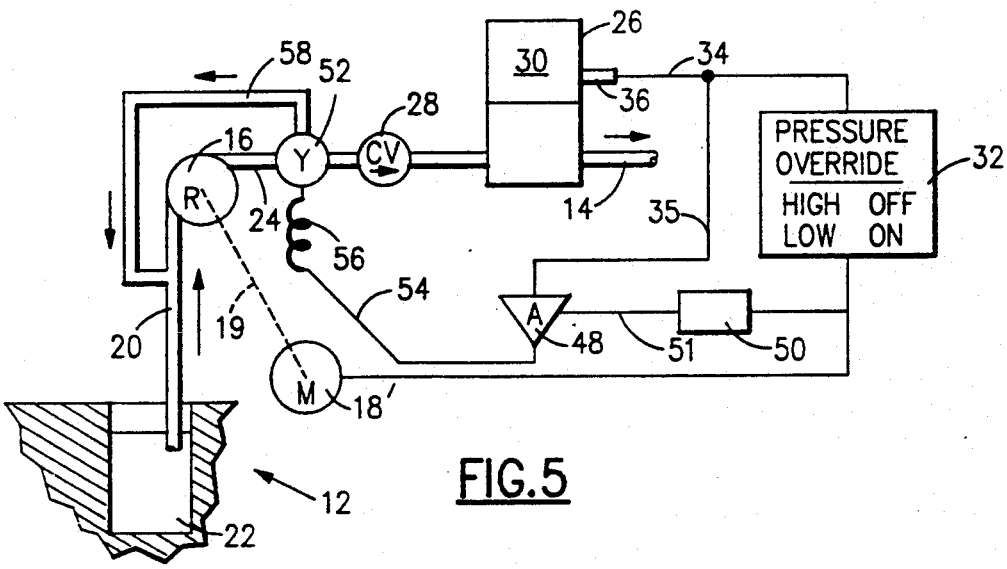

FIG. 5 shows a further embodiment of the invention which may be viewed as a hybrid of those in FIGS. 2 and 3: it includes the solenoid-operated bypass valve 52 of FIG. 2 but uses as the controlling parameter the output signal of tank pressure tap 36 which is fed to control amplifier 48 via a conductor 35; thus the degree of opening of the bypass valve is proportional to the pressure in chamber 30.

Reverting to the spring-loaded bypass valve system of FIG. 3, just as in a conventional system, when the pressure in chamber 30 equals the upper limit set point of switch 32 and no water is being drawn, the constant speed motor 18 and concomitantly pump 16 are stationary. When water consumption begins, the pressure in the chamber falls to a preset point and the pressure switch 32 causes the motor to be energized. The spring-loaded bypass valve 60, normally closed, is constructed and adapted to open in response to a predetermined pressure of water in the outlet conduit 24 of the pump. For a given rate of water consumption, an equilibrium condition is reached at which the bypass is opened to a point where the excess of water being pumped over that being drawn, is recirculated to the well through return conduit 58', as shown in FIG. 3, or directly as will be described in conjunction with the embodiment of FIGS. 6 and 7 to be described presently.

In FIG. 3, if the rate of the water flowing from the tank outlet 14 decreases, the pressure in conduit 24 increases causing the bypass valve to open farther, thus allowing the additional excess water to be recirculated. Except at abnormally low rates of water consumption as explained above in connection with the FIG. 2 embodiment, the pump continues to run without building the pressure in the accumulation chamber to the upper pressure limit which would turn off the power to the pump motor.

Conversely, if the rate at which water is drawn increases, the pressure in line 24 falls causing the bypass valve to close allowing the pump to supply the maximum possible flow volume to meet the additional demand. As long as the rate of draw equals or exceeds pump capacity, the pressure in the tank remains below the upper pressure limit and runs continuously until water usage ceases.

Figure 4:
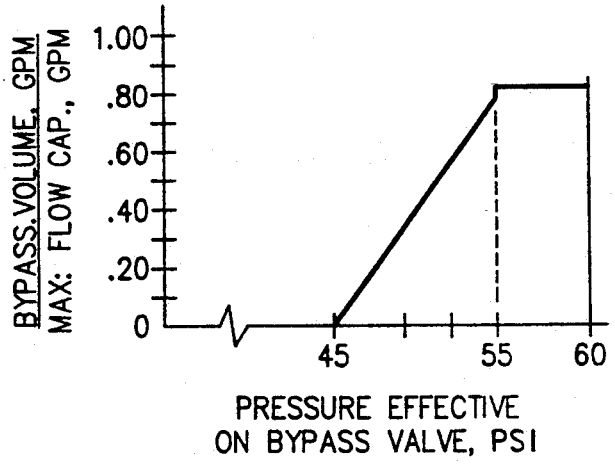
FIG. 4 is a graphic representation of pressure conditions in a system of the type shown in FIG. 3.

As an example of a specific set of working conditions and with reference to FIG. 4, if the low (on) pressure limit is set at 40 psi and the high (off) at 60 psi, bypass valve can be set to begin opening at 45 psi and to reach maximum bypass flow of 80% of pump capacity at 55 psi. At continuous demand less than pump capacity, pressure builds up and the bypass begins to open. If demand is greater than 20% of pump capacity, the bypass flow will reach an equilibrium condition at a tank pressure of 45 to 55 psi. If demand increases, the pressure operating on the bypass valve drops causing the valve to close to a new equilibrium condition. If demand increases further and pressure drops below 45 psi the bypass valve closes entirely and the pump runs continuously as in a conventional system. If demand decreases, the effective pressure increases opening the bypass valve to a new equilibrium up to a maximum bypass flow of 80% If demand is below 20% of capacity, pressure builds up to 60 psi and causes shut down of the pump. At such low demand the pump will cycle on and off as in a conventional system; however, the frequency of the cycles will be quite low under these conditions.

As previously mentioned, most wells used for domestic water supplies are drilled wells and use submersible pumps. In the embodiments of the invention thus far described, the systems have been shown in conjunction with shallow wells for the sake of v simplicity of illustration. A practical application of the principles of the invention to drilled wells will now be described with continued reference to FIGS. 6 and 7.

FIG. 6 shows a segment of a deep well 62 having a casing 63 in which a submersible pump 64 and constant-speed pump-driving motor 66 are installed. Water is drawn from the reservoir through a pump intake pipe 72 and pumped to the surface through an outlet conduit 68. A check valve 70 in outlet conduit 68 or in the outlet port of the pump prevents backflow of water. A bypass valve 74, of the spring-loaded type shown in detail in FIG. 7, recirculates bypass water directly to the well as will be seen as this description proceeds.

At the surface, the system includes a pressure tank 76 having an outlet 78 and an inlet 80 connected to the outlet conduit 68 of pump 64. In a manner and for the purposes already described in conjunction with the previous embodiments of the invention, both inlet and outlet conduits 80 and 78, respectively, are near the bottom of the tank. Also in accord with the previous embodiments, a pressure switch 32 is connected to the tank via a pressure tap 82 and line 84 and to motor 66 via an electrical conductor 86. A check valve 88 in tank inlet conduit 80 prevents backflow into the well of water under pressure in tank 76 during pump-off periods.

With the pump off, the pressure at bypass valve 74 is the pressure head of water in the outlet conduit 68 which is a constant for a particular well. When the pump is turned on and check valves start to open due to incipient flow, pressure at the bypass valve is equal to the pressure head plus tank pressure which equals pump output pressure. With the pump on and water flowing, pressure at bypass valve 74 is the pressure head of the well column plus tank pressure, plus additional pump output pressure to overcome flow losses, plus additional pump pressure to move water up the well output conduit 68.

Flow losses can be approximated by a constant pressure head at average flow conditions and incorporated into the spring pressure loading of the bypass valve. If the flow rate is very low, the bypass will open at a higher tank pressure which will still meet the operating goals of the system. The pressure head due to inertia force on the water can be approximated for average flow rate.

Summarizing the design requirements, the spring force load of the bypass valve is a function of the foregoing operating pressures in the system. The bypass opening point must be set for each particular installation. This is accomplished by means of a bypass valve such as that shown in FIG. 7 having an adjustable spring force load. The device is provided with a spring load calibration keyed to a chart coordinating the head in feet, the tank pressure desired at "bypass open", flow losses (functions of conduit length, diameter and number of elbows), and the average flow rate expected. For selected values, the chart provides a calibration number which is correlated to the calibration markings on the bypass valve permitting appropriate adjustment of spring loading for the system to be installed.

One construction of calibrated bypass valve 74 is shown in enlarged detail in FIG. 7 in which reference numeral 88 designates a section of either the pump outlet conduit 68 or the pump outlet itself. Valve 74 comprises a cylindrical barrel 90 having one end threaded into a bushing 92 in structural section 88. The inner end of barrel 90 is partially closed by an annular end surface 94 defining a central orifice 96. A ball check valve member 98 adapted to seat in and close orifice 96 is urged toward the orifice by one end of a coil loading spring 100 the other end of which bears against an abutment plug 102 adjustably threaded into the outer end of barrel member 90. A tool engaging socket 104 in the outer end of plug 102 accepts an Allen wrench of appropriate size or other tool to facilitate turning plug 102 inwardly or outwardly to increase or decrease the loading force imposed on ball check member 98 by spring 100.

As previously mentioned the bypass valve is calibrated and keyed to a design chart enabling adjustment of the spring load to meet the requirements of the particular installation. The calibration markings, not shown in the drawing, are applied, for example, to the outer surface of barrel member 90; a cap member 105 secured to plug 102 has a cylindrical skirt 106 coaxial with the barrel so as to coact with a line or pointer thereon to indicate the calibration point.

Barrel 90 contains a plurality of elongated apertures or slots, two of which are shown 108 and 110; these apertures provide a flow passages to the well for bypass water when the pressure on the ball check member 98 is sufficient to overcome the spring load and unseat member 98.

Reverting to FIG. 5, it will be noted that the embodiment there shown is an electrical analog of those shown in FIGS. 3 and 6,7. In both cases, the respective bypass valves (60 in FIG. 3, 52 in FIG. 5, and 74 in FIGS. 6,7) are operated in direct proportion to the pressure in the chamber in tank 26 (FIGS. 3,5) or tank 76 (FIG. 6). In the mechanical variants (FIGS. 3 and 6,7) water pressure acts directly on the spring-loaded valve member (e.g., 98 in FIG. 7) whereas in FIG. 5 pressure is converted into an electrical signal which regulates the opening point and degree of opening of the solenoid-operated valve.

In the matter of adjustability of the opening point and the functional relationship between pressure and bypass flow volume, the electrical analog has an advantage: it can be adjusted from the surface after installation of the system whereas, with a spring-loaded bypass, adjustments are necessarily made prior to lowering the pump and motor assembly into the well bore and cannot be changed thereafter except by pulling up the assembly.

What is claimed is:

1. A pumping system for liquid supply, comprising:

a) a source of liquid;

b) a liquid/utilization conduit having an inlet and an outlet;

c) pump means operatively disposed in flow communication between said source and said conduit whereby liquid is supplied to said conduit in response to operation of said pump means;

d) unidirectional flow valve means to prevent reverse flow in said conduit;

e) means for detecting at least one flow parameter associated with, and dependent on the rate of flow through, said inlet and outlet, and utilizing said parameter to control the rate of flow into said conduit, so that the rates of flow into and out of said conduit are substantially equal and said pump runs substantially continuously during water usage for all but the smallest rates of such usage; and f) said pump includes a housing and said bypass conduit is included in said housing to supply liquid to the pump upstream of said source of liquid.

2. A pumping system for fluid supply according to claim 1 wherein said fluid utilization conduit includes, between its inlet and outlet, fluid accumulation chamber means.

3. A pumping system according to claim 1 or 2 wherein the parameter measured is the pressure in pump outlet said of said conduit.

4. A pumping system according to claim 3, further comprising:

a) a bypass conduit interconnecting said fluid source and said inlet;

b) an electrically-operated bypass valve in said bypass conduit; and c) means for applying said parameter to control the degree of opening of said bypass valve in direct proportion to said pressure.

5. A pumping system according to claim 2 wherein said system further includes:

a) pressure sensor means operatively associated with said chamber means for generating an electrical signal corresponding to preselected upper and lower pressure limits in said chamber means; and b) pressure switch means for turning on the pump means upon the attainment of said lower limit and off at the attainment of the upper limit.

6. A pumping system according to claim 1 wherein a) said detecting means is a bypass valve in flow communication with said inlet and having a bypass conduit interconnecting said source and inlet;

b) said bypass valve includes a valve member and resilient means urging said valve member to normally close said bypass conduit; and c) said parameter is the fluid pressure effective on said valve member urging the valve member toward an open condition against the urging of said resilient means.

7. A pumping system according to claim 6 wherein said bypass valve comprises:

a) a hollow cylindrical barrel having an aperture at one end in flow communication with said inlet, said resilient means being disposed in said barrel so as to exert axially-directed force to seat said valve member in said aperture;

b) adjustment means operative to select the magnitude of said force; and c) flow passage means through the walls of said barrel member accommodating flow of bypass fluid to said source.

8. A pumping system according to claim 7 wherein said adjustment means is calibrated to permit adjustment of the opening pressure of the bypass valve in accordance with system design requirements.

9. A pumping system according to claim 6 wherein the bypass valve is incorporated in the housing.

10. A pumping system for liquid supply, comprising:

a) a source of liquid;

b) a liquid utilization conduit having an inlet and an outlet;

c) variable speed pump means operatively disposed in flow communication between said source and said conduit whereby liquid is supplied to said conduit in response to operation of said pump means;

d) detecting means for measuring parameters representative of the respective rates of flow into and out of said water utilization conduit; and e) means for generating an error signal representative of the respective flow rates and applying said signal to control the variable speed pump to minimize said difference.

11. A pumping system for liquid supply, comprising;

a) a source of liquid;

b) a liquid utilization conduit having an inlet and an outlet;

c) constant speed pump means operatively disposed in flow communication between said source and said conduit whereby liquid is supplied to said conduit in response to operation of said pump means;

d) detecting means for measuring parameters representative of the respective rates of flow into and out of said utilization conduit;

e) means for generating an error signal representative of the difference in said flow rates;

f) a bypass conduit interconnecting said liquid source and said inlet;

g) an electrically-operated bypass valve in said bypass conduit; and h) means for applying said error signal to control said bypass valve to minimize said difference.

12. A pumping system for fluid supply comprising:

a) a source of fluid;

b) fluid accumulation chamber means having an inlet and outlet;

c) pressure sensor means operatively associated with said chamber means for generating an electrical signal corresponding to preselected upper and lower pressure limits in said chamber means;

d) pressure switch means coupled to said pressure sensor means for turning on said pump means upon the attainment of said lower limit and off at the attainment of the upper limit;

e) variable speed pump means operatively disposed in flow communication between said water source and inlet whereby fluid is supplied to said chamber means in response to operation of said pump means;

f) respective flow rate measuring devices, associated with said inlet and outlet, operative to generate output signals representative of the respective rates of flow of water into and out of said chamber;

g) mean for comparing said outlet signals to generate an error sign representative of the difference in said respective flow rates; and h) means for applying said error signal to control the variable speed pump to minimize said difference.

13. A pumping system for domestic fluid supply comprising:

a) a source of fluid;

b) water accumulation chamber means having an inlet and outlet;

c) pressure sensor means operatively associated with said chamber means for generating an electrical signal corresponding to preselected upper and lower pressure limits in said chamber means;

d) pressure switch means coupled to said pressure sensor means for turning on said pump means upon the attainment of said lower limit and off at the attainment of the upper limit;

e) constant speed pump means operatively disposed in flow communication between said fluid source and inlet whereby fluid is supplied to said chamber means in response to operation of said pump means;

f) respective flow rate measuring devices, associated with said inlet and outlet, operative to generate output signals representative of the respective rates of flow of fluid into and out of said chamber;

g) an adjustable bypass valve in said inlet for recirculating fluid bypassed by said valve when open;

h) means for comparing said output signals to generate an error signal representative of the difference in said respective flow rates; and i) means for applying said error signal to regulate the degree of opening of said bypass valve so as to maintain substantial equality in said flow rates and with concomitant substantially continuous operation of said pump during fluid usage.

* * * * *